US005094075A

United States Patent [19]

Berendes

[11] Patent Number: 5,094,075

[45] Date of Patent: Mar. 10, 1992

[54] PARTICULATE FILTER SYSTEM

[75] Inventor: Heinrich Berendes, Cologne, Fed. Rep. of Germany

[73] Assignee: Kloeckner-Humboldt-Deutz AG, Cologne, Fed. Rep. of Germany

[21] Appl. No.: 429,019

[22] Filed: Oct. 30, 1989

[30] Foreign Application Priority Data

Nov. 4, 1988 [DE] Fed. Rep. of Germany ..... 3837472

[51] Int. Cl.[5] ..... F01N 3/02

[52] U.S. Cl. ..... 60/303; 55/523; 55/DIG. 30; 55/311

[58] Field of Search ..... 55/DIG. 30, 523, 96; 60/303, 311, 213, 459.1, 286

[56] References Cited

U.S. PATENT DOCUMENTS 4,571,938 2/1986 Sakuyai ..... 55/DIG. 30 X
4,603,550 8/1986 Shinzawa ..... 55/DIG. 30 X
4,604,868 8/1986 Nomoto et al. ..... 55/DIG. 30 X
4,615,173 10/1986 Usui ..... 55/DIG. 30 X
4,622,810 11/1986 Shinsei et al. ..... 55/DIG. 30 X
4,651,524 3/1987 Brighton ..... 55/DIG. 30 X
4,665,690 5/1987 Nomoto et al. ..... 55/DIG. 30 X

*Primary Examiner*—Charles Hart
*Attorney, Agent, or Firm*—Charles L. Schwab

[57] ABSTRACT

Method and apparatus for regenerating a particulate filter of a diesel engine. Disclosed is a particulate filter that, at all operating points of the diesel engine, can be regenerated by means of a burner working in the main engine exhaust stream. Regeneration is achieved by means of a burner (3) to which fuel and oxygen-containing gas is supplied in a variable proportion. By this means, the burner can produce the output required to achieve the regeneration temperature at any operating point of the diesel engine. The apparatus is suitable for diesel engines having thermally regenerable particulate filters.

11 Claims, 3 Drawing Sheets

PARTICULATE FILTER SYSTEM

TECHNICAL FIELD

This invention relates to an apparatus for regenerating particulate filters of the type used in exhaust systems of internal combustion engines.

PRIOR ART STATEMENT

Particulate emission is a disadvantage of the diesel engine that results from the process employed. Up to the present, attempts have been made to solve this problem through measures internal to the engine. Increasingly stringent requirements on automotive engines will, however, necessitate the use of particulate filters in the exhaust gas stream.

One prior art particulate filter system uses a ceramic filter, arranged in the main exhaust gas stream, that can be regenerated by burning off the particulate deposit while the engine is running.

Since the exhaust-gas temperature of over 550 degrees Celsius required for regeneration is not, as a rule, reached during engine operation, the exhaust gas has to be heated appropriately.

This purpose is served by a burner having an air-swirl atomizing nozzle, which is supplied with compressed air at a constant substoichiometric flow rate. In a secondary combustion chamber, the uncombusted residues of hot gases leaving the burner react with the residual oxygen in the diesel engine exhaust gases introduced there. By this means the temperature required for regeneration is attained.

The burner output needed for this purpose depends on the instantaneous quantity and temperature of the exhaust gas from the diesel engine and thus on its speed and load. A mixture quantity, and thus burner output, that is constant or depends on the engine speed alone, as used in prior art systems cannot satisfy this requirement.

For the efficiency and life of the particulate filter, it is important that the surface of said filter be uniformly loaded with particulates and the combustion of the particulates be uniform and complete. This is the only way to maximize the service life of the particulate filter between regenerations and avoid thermal stresses with the associated thermal cracks in the ceramic filter pad.

With the particulate filter of the prior art system the engine exhaust gas and the hot burner gas, traveling radially from inward to outward, enter a secondary combustion chamber ahead of the particulate filter. In this way the outer marginal portions of the particulate filter are preferentially loaded with particulates and preferentially regenerated in the regeneration phase. Hence it follows that the utilization of the filter area in conjunction with the thermal stresses is not optimal.

OBJECTS AND SUMMARY OF THE INVENTION

It is the object of the invention to create an improved particulate filter system that is regenerable over the entire operating range of the diesel engine without endangering the particulate filter.

By virtue of the solution in accordance with the invention, the burner output can be arbitrarily varied, within the framework of the quantity of oxygen supplied directly to the burner and available as residual oxygen in the diesel engine exhaust gas, by varying the fuel quantity alone.

In this way it is possible to satisfy the requirement that an approximately constant and sufficiently high regeneration temperature and thus complete regeneration of the particulate filter be effected throughout the operating range of the diesel engine. The prerequisite for completely automatic, driver-independent regeneration is thus also satisfied.

In one embodiment of the invention the proportion of fuel and oxygen-containing gas supplied to the regenerative filter burner is approximately stoichiometric at the operating point of the diesel engine at which the output of the burner required for reaching the regenerative temperature is lowest, and is substoichiometric at all other operating points of the diesel engine. This offers the advantage of the smallest possible quantity of burner air and thus the lowest possible fuel consumption for conveyance and heating of said air.

In another embodiment of the invention the quantities of fuel and oxygen-containing gas supplied to the burner are variable throughout the operating range of the diesel engine. This offers the advantage that optimal adaptation of the quantities of fuel and oxygen-containing gas can be effected for any operating point of the internal combustion engine.

In another embodiment of the invention the quantity of oxygen-containing gas supplied to the burner may be varied in proportion to the speed of the engine. This offers the advantage of a simple burner air supply installation, whose delivery characteristic can be varied in a simple fashion. Or the air quantity may be proportional to engine speed over part of the engine speed range and hold generally constant starting at a certain speed of the engine.

The supply of a constant quantity of air to the burner makes possible a particularly simple approach to the burner air supply, provided a compressed-air source of approximately constant pressure, as is usual in commercial vehicles, is available in conjunction with a supercritical flow nozzle.

The object of the invention is also achieved by means of the provision of a particulate filter with an air-swirl atomizing nozzle if a main combustion chamber importing a primary swirling flow of burning gases to a secondary combustion chamber to which the exhaust gas is supplied in a direction of swirling flow opposite to the primary swirling flow. By virtue of the embodiment in accordance with the invention it is achieved that the exhaust gas of the internal combustion during normal engine operation is uniformly distributed in the secondary combustion chamber by the swirling flow and thus uniformly loads the particulate filter. It is further achieved that, by virtue of their opposing senses of swirl, the exhaust-gas streams of the diesel engine and the burner mix intensively during regeneration in the manner of shear-flow mixing and thus, via a uniform temperature distribution ahead of the particulate filter, lead to the uniform, complete and gentle regeneration of said filter.

If flow-guiding devices or similar internals are present in the secondary combustion chamber, for example, flow deflectors or flow restrictors arranged radially in the secondary combustion chamber, it may be advantageous to establish the direction of swirl in the primary combustion chamber and the secondary combustion chamber in the same sense.

The exhaust line may be connected to the periphery of the secondary combustion chamber, which offers the advantage of short structural length of the particulate filter system, an advantage that is further reinforced by connecting the exhaust line to the upstream part of the secondary combustion chamber whereby the mixing and homogenizing path of the exhaust gas to the particulate filter is maximized.

The use of a plurality of branch line exhaust connections equally spaced circumferentially about a cylindrical secondary combustion chamber offers the advantage of a symmetrical flow, which leads to uniform mixing of the individual exhaust-gas streams during loading of the particulate filter and additionally to uniform mixing of the combustion gas during regeneration.

By placing the primary combustion chamber inside the upstream part of the secondary combustion chamber, one can achieve the greatest possible mixing path length for the exhaust gas of the internal combustion engine and of the burner. What is more, the combustion chamber is cooled by the engine exhaust gas, the absorbed heat directly benefiting regeneration.

A departure from this preferred configuration and embodiment of the primary combustion chamber is also possible. For example, in certain applications it may be advantageous to install the entire primary combustion chamber in the secondary combustion chamber so that a clearance is produced between the front wall of the secondary combustion chamber and the primary combustion chamber, which clearance allows the making of axial holes in the front wall of the primary combustion chamber.

It may, however, also be advantageous to place the primary combustion chamber at least partially outside and ahead of the secondary combustion chamber.

It may also be advantageous not to place the primary combustion chamber coaxially with the secondary combustion chamber but offset from the center of the secondary combustion chamber. The axis of the primary combustion chamber can be parallel to the axis of the secondary combustion chamber or can intersect or be skew with respect to said axis.

In installations having the shortest possible structural length of the particulate filter system, it is also conceivable to place the primary combustion chamber at the periphery of the secondary combustion chamber and outside the same. The direction of inflow into the secondary combustion chamber can be radial or tangential; the tangential inflow can be directed in the same sense as or in the opposite sense to the flow of the exhaust-gas line.

The provision of holes in the periphery of the primary combustion chamber prevents negative effects of diesel-engine exhaust-gas pulsations on the stability of the flame in the primary combustion chamber and allows the admixture of oxygen-containing exhaust gas into the primary combustion chamber. The provision of a baffle ahead of the particle filter in alignment with the outlet opening of the primary combustion chamber offers the advantage that, in the event of ignition failure, the fuel cannot reach the central region of the particulate filter, which would lead to overheating and partial destruction of the filter.

Because of the relatively small diameter of the baffle and its great distance from the outlet opening of the primary combustion chamber, the baffle does not substantially affect the flow, so that uniform loading of the particulate filter is still insured.

A pressure tank may be used to supply air to the burner. This provides an approximately constant pressure supply to the primary combustion chamber. One such air supply source is compressed-air tank of commercial vehicles. The supercritical nozzle offers the advantage that an approximately constant quantity of air is delivered even in the case of certain pressure fluctuations in the supply tank.

By connecting the gas line to the exhaust-gas line via a solenoid valve and placing a throttle valve in the exhaust-gas line downstream of the branching of the gas line, a "push button" regeneration unit is provided. In contrast to fully automatic regeneration, this is initiated at the wish of the driver by a press of a button when the engine is idling. Since there is a large air excess in the engine exhaust gas when the internal combustion engine is in this operating condition, external oxygen supply can be dispensed with. By this means, the construction cost for the regeneration system is particularly low, but the operating cost is increased.

BRIEF DESCRIPTION OF THE DRAWINGS

Other features of the invention can be found in the description that follows and in the drawing, in which an exemplary embodiment of the invention is illustrated schematically.

DETAILED DESCRIPTION OF THE DRAWINGS

Figure 1:
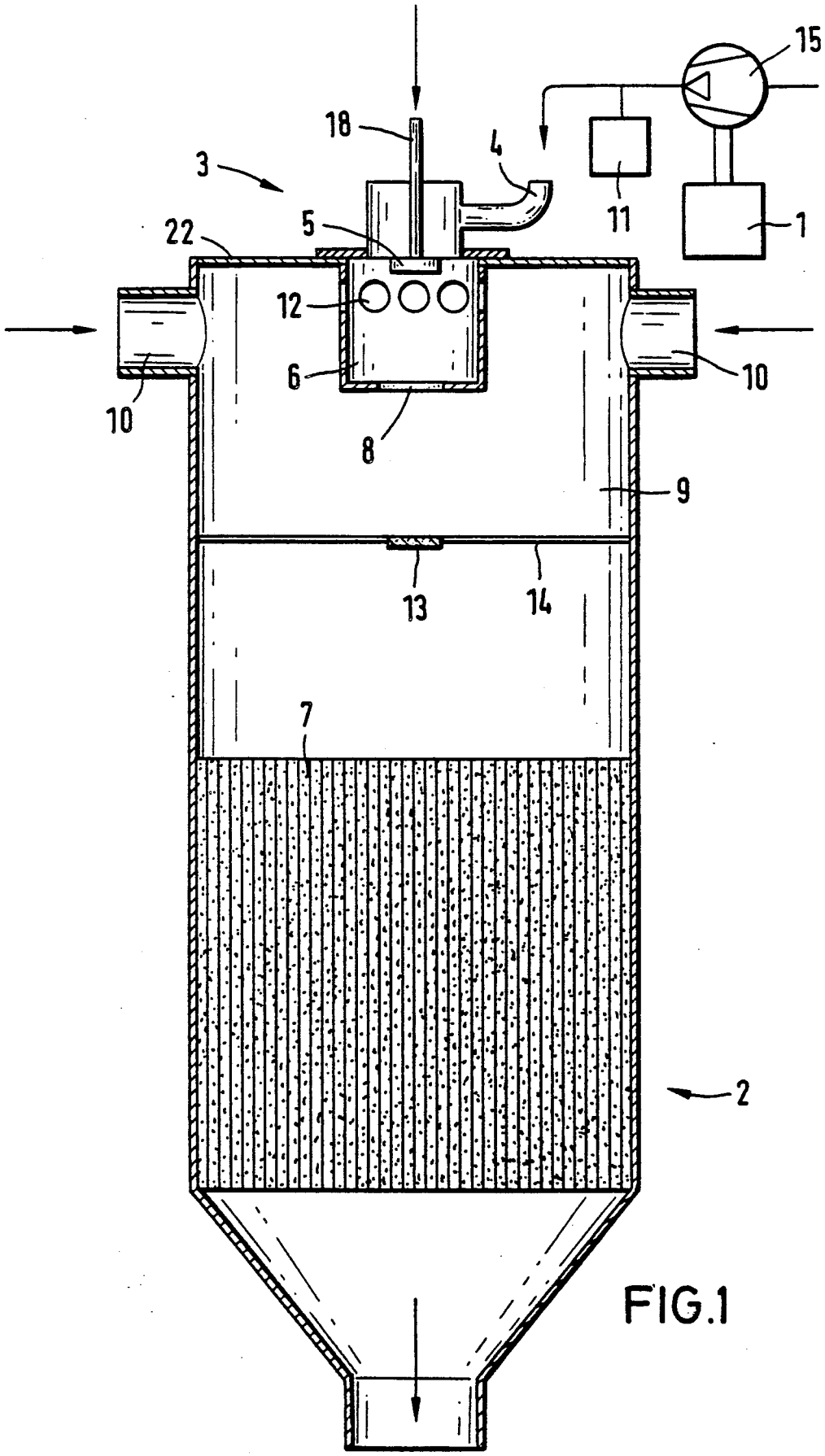
FIG. 1 shows a longitudinal section through the particulate filter system having air supplied to the air-swirl atomizing nozzle by means of a positive-displacement blower.

The particulate filter system 2 consists of a burner 3 and a particulate filter 7, both of which are arranged in the main stream of an exhaust-gas line 10 of a diesel engine 1. The burner 3 consists of an air-swirl atomizing nozzle 5, a primary combustion chamber 6 and a secondary combustion chamber 9.

The air-swirl atomizing nozzle 5 is supplied with fuel at low pressure from a conveyance and metering means, not illustrated, via the fuel supply line 18. Compressed air at low pressure is supplied via the gas line 4. In the embodiment of FIG. 1, said gas line is connected to a positive-displacement blower 15 driven by the diesel engine 1, with which blower a bleeder valve 11 is associated.

Figure 3:
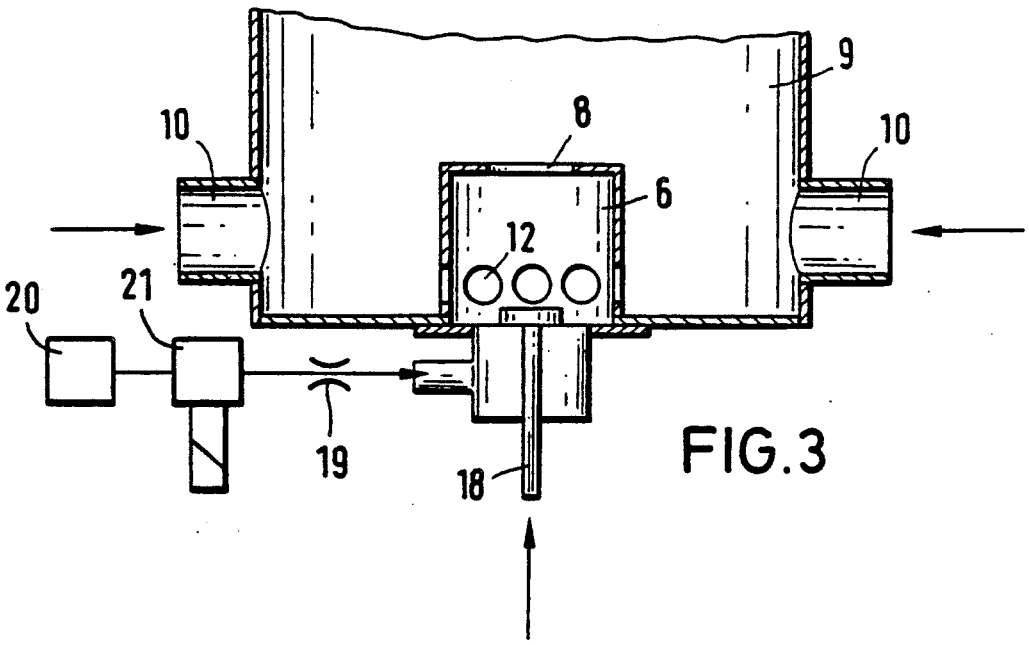
FIG. 3 shows a longitudinal section through the particulate filter system having air supplied to the air-swirl atomizing nozzle from a constant-pressure source.

In the embodiment of FIG. 3, the air-swirl atomizing nozzle 5 is connected to a pressure tank 20 via a solenoid valve 21 and a supercritical flow nozzle 19.

Figure 4:
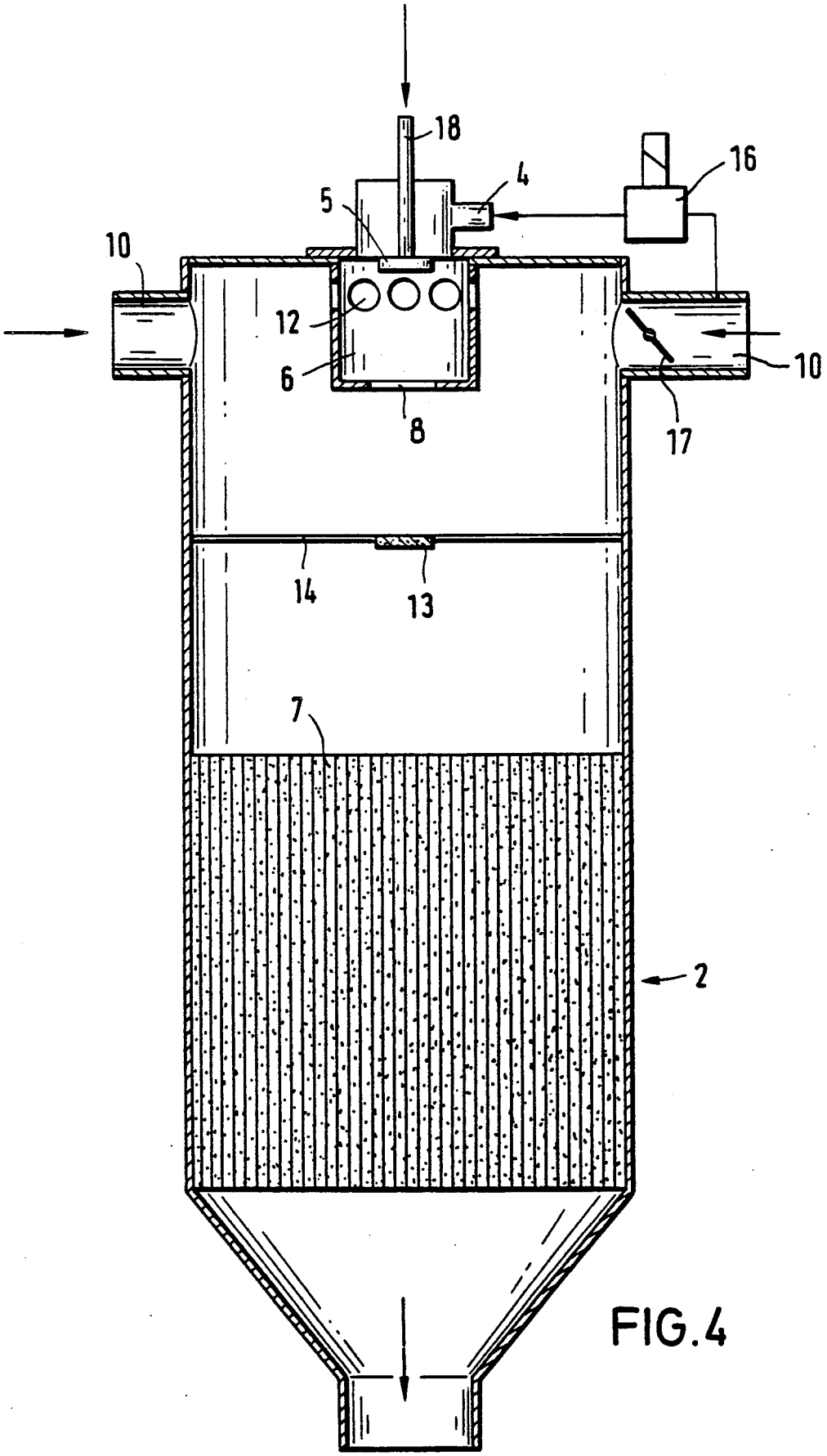
FIG. 4 shows a longitudinal section through the particulate filter system having oxygen supplied to the air-swirl atomizing nozzle by means of the introduction of engine exhaust gas.

In the solution in accordance with FIG. 4, there is a connection between the exhaust-gas line 10 and the gas line 4, a throttle valve 17 being arranged in the exhaust-gas line 10 and a solenoid valve 16 being arranged in the gas line 4.

The air-swirl atomizing nozzle 5 is connected behind the primary combustion chamber 6. The primary combustion chamber 6 sits coaxially in the secondary combustion chamber 9, to whose front wall 22 it is fastened.

The primary combustion chamber 6 has an axial outlet opening 8, whose diameter is approximately 60 to 80% of the diameter of the primary combustion chamber 6. What is more, holes 12 are made at the periphery of the primary combustion chamber 6 in its upstream third. These holes have a total cross-sectional area of 5 and 20% of the cross-sectional area of the primary combustion chamber.

Figure 2:
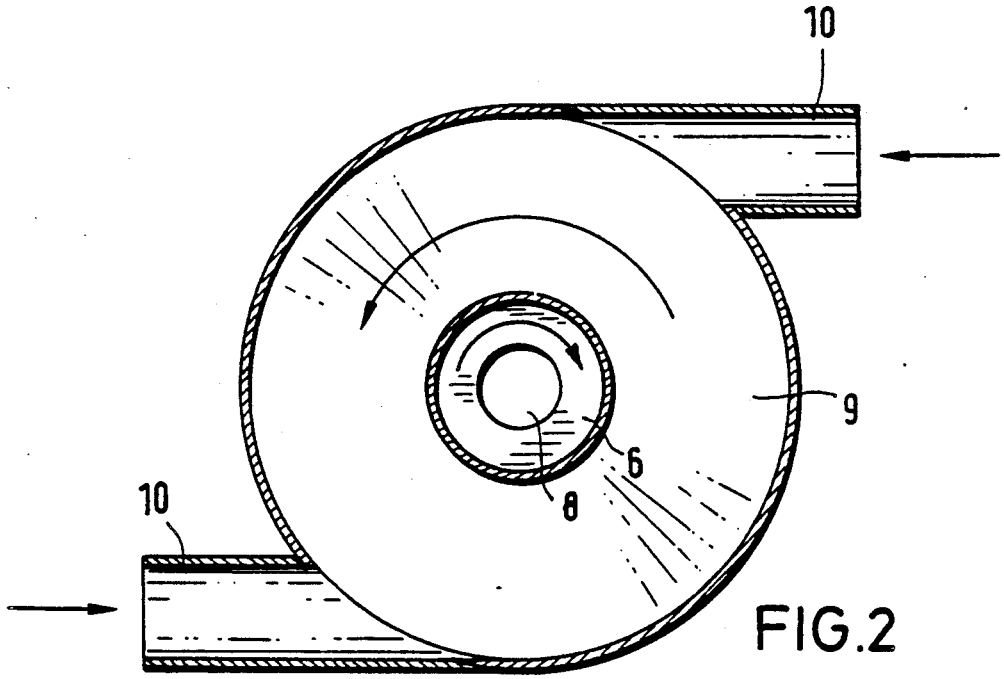
FIG. 2 shows a transverse section through the primary combustion chamber and the secondary combustion chamber having two exhaust-gas lines that discharge tangentially into the secondary combustion chamber.

The secondary combustion chamber 9, like the primary combustion chamber 6, is cylindrical. The exhaust-gas line 10 is connected at its periphery and in the upstream part. In the case of a plurality of exhaust-gas lines 10, their spacings at the periphery of the secondary combustion chamber 9 are equal, as illustrated in FIG. 2.

The particulate filter 7 follows the primary combustion chamber 9. It is a monolithic ceramic filter of conventional design.

Between the outlet opening 8 of the primary combustion chamber 6 and the particulate filter 7 there is a circular baffle 13, which is connected, for example via spokes 14, to the periphery of the secondary combustion chamber 9. The baffle 13, which consists of heat-resistant material such as, for example, ceramic, has a diameter equal to approximately 60% of the diameter of the primary combustion chamber and a distance from the opening 8 equal to approximately 150% of the diameter of the primary combustion chamber.

The particulate filter system functions in the following way:

In normal engine operation, the exhaust gas from the diesel engine 1 passes by means of the exhaust-gas line 10 tangentially into the secondary combustion chamber 9 and there brings about a swirling flow. In the case of two or a plurality of exhaust-gas lines, as are usual, for example, in V-type engines, any differences in exhaust-gas temperature and particulate content between the several exhaust-gas lines 10 are equalized by means of the swirling flow in the secondary combustion chamber 9. This homogenization of the exhaust-gas flow leads to uniform loading and thus to optimal utilization of the particulate filter.

The exhaust-gas back pressure of the diesel engine 1 thus rises. When the exhaust-gas back pressure has reached a certain level, the burner 3 is automatically turned on during normal operation of the diesel engine 1 in order to regenerate the particulate filter 7.

By this means, fuel is provided to the air-swirl atomizing nozzle 5 via the fuel line 18 and air via the gas line 4.

The fuel is delivered at relatively low pressure from a source, not illustrated, for example the fuel pump of the diesel engine 1. The quantity of said fuel is dictated by the instantaneous load or exhaust-gas temperature and speed of the diesel engine 1.

The air, which is likewise at a relatively low pressure, is conveyed to the air-swirl atomizing nozzle either from a positive-displacement blower 15 driven by the diesel engine or from a pressure tank 20, via a solenoid valve 21 and via a supercritical nozzle 19.

The solution with the pressure tank 20 suggests itself in the case of vehicles having air brakes and a correspondingly sized air compressor. This approach, which is simple in design terms, provides a largely constant air pressure ahead of the air-swirl atomizing nozzle 5 even when the tank pressure is not quite constant.

In contrast, the pressure supplied by the positive-displacement blower 15 depends on the speed of the diesel engine 1, a bleeder valve 11 being provided for pressure limiting.

The quantity of air supplied to the air-swirl atomizing nozzle 5, and thus also the energy required for its conveyance and heating, is relatively slight, since in the particulate filter system 1 in accordance with the invention the residual oxygen in the diesel engine exhaust gas is employed for regenerating the particulate filter 7.

The residual oxygen content in the exhaust gas of a diesel engine is between approximately 7% at full load and approximately 18% at idle. The 7% residual oxygen content at full load is just sufficient to effect regeneration in a reasonable time, provided that the exhaust-gas temperature at this load point reaches the regeneration temperature. This is the case only in diesel engines with a relatively high rated speed. In the case of city bus engines, for which above all particulate filters are employed, the rated speed is chosen relatively low on grounds of consumption and emissions, so that the maximum exhaust-gas temperature also remains relatively low. For this reason, the burner 3 must operate even at the full-load point of the rated speed, the point of lowest required burner output, in order to reach the regeneration temperature. Since only the minimum requisite quantity of oxygen is present in the exhaust gas at this operating point, no oxygen may be withdrawn from the exhaust gas. For this reason, the fuel-air mixture of the burner 3 at this operating point is roughly stoichiometric. In this way, the regeneration temperature is reached with the smallest possible additional quantity of air and without drawing on the residual oxygen content of the exhaust gas.

At all other operating points of the diesel engine 1, a higher burner output and thus a larger quantity of fuel is necessary; in the case of a constant or decreasing quantity of air, this results in a substoichiometric mixture in the burner 3. The oxygen lack is then supplied by the engine exhaust gas, whose residual oxygen content increases with the required burner output in each instance.

In the air-swirl atomizing nozzle 5, the inlet compressed air forms a swirling flow, which leads to fine atomizing of the fuel on a knife-edge.

The fuel-air mixture moves in swirling fashion out of the air-swirl atomizing nozzle 5 into the primary combustion chamber 6 and is there ignited with the aid of a high-voltage igniting device, not illustrated.

By virtue of the swirling flow in the primary combustion chamber 6, an underpressure zone is formed on the axis of said chamber. By this means, the burning gases flow back toward the air-swirl atomizing nozzle 5 and form a toroidal vortex.

Freshly injected mixture encounters this toroidal vortex and is intensively worked by means of multiple recirculation.

The stationary toroidal vortex further acts as a flame retainer, by which means a stable flame is insured in the primary combustion chamber 6.

The stability of the flame also depends on pressure fluctuations in the primary combustion chamber 6, which originate in the exhaust-gas stream of the diesel engine 1. These pressure fluctuations are largely attenuated by the holes 12 at the periphery of the primary combustion chamber 6. In the region of the holes 12, by virtue of the ejector action of the air-swirl atomizing nozzle 5, an underpressure prevails in the primary combustion chamber 6, by means of which the pulsating exhaust gas from the secondary combustion chamber 9 enters the primary combustion chamber 6. Because the exhaust-gas pressure fluctuations are simultaneously effective at the opening 8 of the primary combustion chamber 6 as well, their action on the flame in the primary combustion chamber 6 is largely weakened.

What is more, residual oxygen enters the primary combustion chamber 6 through the holes 12 with the exhaust gas; this leads to a desirably leaner mixture, especially in the case of a very rich mixture, limiting a desirable migration of the flame out of the primary combustion chamber 6 and thus preventing the separation and extinguishing of the flame.

Another possibility for working the residual oxygen of the exhaust gas from the internal combustion engine while still in the primary combustion chamber 6 is to supply exhaust gas from the exhaust-gas line 10, instead of external air, to the air-swirl atomizing nozzle 5, as illustrated in FIG. 4. By opening a solenoid valve 16 and simultaneously closing a throttle valve 17, the required flow connection is created via the gas line 4. The needed pressure difference between air-swirl atomizing nozzle 5 and primary combustion chamber 6 is achieved by means of a deliberate leakiness of the throttle valve 17, which has either a well-defined opening or a well-defined clearance to the exhaust-gas line 10. This type of regeneration functions only at idle, since only at this operating point is there a sufficiently high residual oxygen content in the exhaust gas. For this reason, automatic regeneration is not possible, so that in this case regeneration must be initiated by the driver's pressing a button.

In case of non-ignition of the primary combustion chamber 6, the baffle 13 supported in front of the opening 8 of the primary combustion chamber 6 prevents unburned fuel from reaching the particulate filter 7 and endangering said filter by overheating once ignition has taken place. Since the baffle 13 is in the hot exhaust-gas stream, it is itself hot and, until the ignition of the fuel-air mixture, acts as a surface carburetor for the fuel. By virtue of its small size in relation to the diameter of the secondary combustion chamber 9, it has no effect on the uniformity of the flow in the secondary combustion chamber 9.

The combustion of a partially substoichiometric mixture in the primary combustion chamber 6 leads, by virtue of the intensive mixture working, to a particulate-free partial combustion with the formation of much CO, $H_2$ and radicals. In the secondary combustion chamber 9, these gases combine with part of the residual oxygen from the exhaust gas, the mixing of the exhaust gas with reaction gas exiting from the primary combustion chamber 6 taking place, in accordance with the invention, in the manner of shear-flow mixing, because of the opposing sense of rotation of the swirling motion in the primary combustion chamber and the secondary combustion chamber.

This intensive mixing process has the effect that the secondary combustion chamber 9 and thus also the front face of the particulate filter 7 are uniformly acted on by flames. Starting from individual ignition foci, a uniform and gentle burning of the particulate deposit on the particulate filter 7 is thus achieved.

The embodiments of the invention in which an exclusive property or privilege is claimed are defined as follows:

1. A particular filter system having a particulate filter (7) and burner (3) in the main stream of an exhaust-gas line (10) of a diesel engine (1), said burner (3) including a primary combustion chamber (6) with an outlet opening (8), a cylindrical secondary combustion chamber (9) aligned with said outlet opening (8), an air swirl atomizing nozzle (5) in said primary combustion chamber (6) creating a swirling flow of burning gases in said primary combustion chamber (6) which discharge through said outlet opening (8) into said secondary combustion chamber (9), said exhaust gas line (10) having two branches connected tangentially to the upstream part of said cylindrical secondary combustion chamber (9) at diametrically opposite sides thereof whereby exhaust gases discharged by said branches into said secondary combustion chamber (9) flow in a swirl having a direction opposite to the direction of swirling flow in said primary combustion chamber (6).

2. The particulate filter system of claim 1 wherein said primary combustion chamber (6) is disposed within said upstream part of said secondary combustion chamber (9).

3. The particular filter system of claim 2 wherein holes (12) are formed in the periphery of said primary combustion chamber (6).

4. The particulate filter system of claim 3 wherein said holes (12) are disposed in the upstream third of said primary combustion chamber (6) and their cross-sectional area is 5 to 20% of the cross-sectional area of said primary combustion chamber (6).

5. The particulate filter system of claim 1 wherein a baffle (13) is mounted in said secondary combustion chamber upstream of said particulate filter (7) and coaxially with said outlet opening (8) of said primary combustion chamber (6), said baffle 13 being circular and its diameter being equal to approximately 60% of the diameter of the primary combustion chamber (6).

6. The particulate filter system of claim 5 wherein said baffle 13 is spaced from said primary chamber a distance equal to approximately 150% of the diameter of said primary combustion chamber (6).

7. The particulate filter system of claim 5 wherein said baffle (13) consists of heat-resistant material.

8. The particulate filter system of claim 1 and further comprising a positive-displacement blower (15) connected in driven relation to said internal combustion engine (1) and a gas line (4) interconnecting the discharge side of said blower (15) with said primary combustion chamber (6).

9. The particulate filter system of claim 8 wherein a bleeder valve (11) is disposed in said gas line (4).

10. The particulate filter system of claim 8 and further comprising a pressure tank (20) of substantially constant pressure, said gas line (4) being connected to said pressure tank (20), a solenoid valve in said gas line (4) and a flow throttle (19) in said gas line between said solenoid valve and said primary combustion chamber (6), said flow throttle operating as a supercritical nozzle.

11. A particulate filter system of claim 1 and further comprising a gas line (4) interconnecting said exhaust-gas line (10) and said primary combustion chamber, a solenoid valve (16) in said gas line, and a throttle valve (17) in said exhaust-gas line (10) donwstream of the latter's connection with said gas line (4).

* * * * *

UNITED STATES PATENT AND TRADEMARK OFFICE

CERTIFICATE OF CORRECTION

PATENT NO. : 5,094,075

DATED : Mar. 10, 1992

INVENTOR(S) : Heinrich Berendes

It is certified that error appears in the above-identified patent and that said Letters Patent is hereby corrected as shown below:

Column 8, line 1, cancel "particular" and substitute --- "particulate" ---

Column 8, line 23, cancel "particular" and substitute --- "particulate" ---

Signed and Sealed this

Twenty-fifth Day of May, 1993

*Attest:*

Michael K. Kirk

MICHAEL K. KIRK

*Attesting Officer*

*Acting Commissioner of Patents and Trademarks*